US005080373A

United States Patent [19]

Jones

[11] Patent Number: 5,080,373

[45] Date of Patent: Jan. 14, 1992

[54] ROPING TRAINING APPARATUS AND METHOD

[76] Inventor: David E. Jones, 3600 Kiphen Rd., Round Rock, Tex. 78664

[21] Appl. No.: 604,576

[22] Filed: Oct. 25, 1990

[51] Int. Cl.[5] ..... A63B 69/00

[52] U.S. Cl. ..... 273/338; 434/247

[58] Field of Search ..... 273/336, 337, 338, 339; 434/247

[56] References Cited

U.S. PATENT DOCUMENTS

| | | | |
|---|---|---|---|
| 4,364,570 | 12/1982 | Hallam | 273/338 |
| 4,451,045 | 5/1984 | Fesmire | 273/338 |
| 4,498,676 | 2/1985 | Runner | 273/336 |
| 4,640,515 | 2/1987 | Rhine | 273/339 |
| 4,874,179 | 10/1989 | Henderson | 273/338 |
| 4,981,302 | 1/1991 | Narramore | 273/339 |
| 5,009,432 | 4/1991 | Richard | 273/339 |

OTHER PUBLICATIONS

Magazine ad in *Rodeo Times*, published in United States "Mr. Higley & Skamper"—Jul. 1989 issue.

Magazine ad in *Rodeo Times*, published in United States "Handy Heeler" Roping Machines—Sep. 1988 issue.

*Primary Examiner*—William H. Grieb

*Attorney, Agent, or Firm*—Shaffer & Culbertson

[57] ABSTRACT

A roping training appartus is adapted to simulate on a fixed platform the relative movement between a rider and an object to be roped in certain roping maneuvers, particularly heading and heeling in Dally team roping. The roping training device includes an elongated roping target and a mount simulator for supporting a trainee in a riding position within a desired training distance range from the target body. The target body is mounted on a target body pivot mechanism to allow the roping target body to pivot about a substantially vertical target rotational axis and the mount simulator is mounted on a mount pivot mechanism enabling the mount simulator to pivot about a substantially vertical mount rotational axis. The mount rotational axis and the target rotational axis are offset a desired initial heeling separation distance along an X coordinate axis and a desired initial heading separation distance along a Y coordinate axis, the X and Y axes being substantially perpendicular and defining a horizontal plane. A pivoting arrangement is connected to both the roping target and the mount simulator for pivoting the roping target body about its rotational axis and the mount simulator about its rotational axis, each a simulating angular displacement in the same rotational direction to simulate the relative movement between a rider and an object to be roped to simulate certain roping maneuvers.

20 Claims, 8 Drawing Sheets

ROPING TRAINING APPARATUS AND METHOD

BACKGROUND OF THE INVENTION

This invention relates to devices for training roping skills, and particularly, to a training device for training competition roping skills. The invention also encompasses a roping training method.

Roping is a practical skill required in the ranching industry, and steer and calf roping survive today as popular spectator and participation sports. Both amateur and professional rodeos include various types of roping competitions. Calf roping and various types of steer roping are all popular rodeo events.

Dally team roping is a popular steer roping competition in modern rodeo. In Dally team roping, a team of riders consisting of a header and a heeler cooperate to rope the horns and hind legs of a steer as the steer runs along the rodeo arena. The competition starts with the steer in a center chute with the header positioned on the left hand side of the steer and the heeler positioned on the right hand side. When the steer is released and runs from the chute, the header and heeler follow the steer out into the arena until the header ropes the steer at its head and then turns the steer off approximately 90° to the left. This 90° turn to the left allows the heeler to turn his horse in behind the steer and cross over to the left hand side of the steer to a proper roping position. Once in the roping position, the heeler ropes the hind legs of the steer. The header and heeler then stretch the steer between the two horses.

A good deal of skill is required in both heading and heeling and both maneuvers require a great deal of training. The traditional training technique was to repeat each maneuver with live animals. However, this traditional training technique was time consuming, expensive in that the livestock had to be maintained, and required a large arena with a suitable chute for the steers.

Another roping training method was to simply have the trainee stand on the ground and practice roping a stationary practice dummy. Although this training technique was inexpensive, it was also unrealistic in that the perspective of the person training was substantially different than the perspective he would have in a riding position on a horse.

A more recent training method employed a practice dummy which was pulled or otherwise propelled so that a rider could follow along behind the dummy to practice roping. Although this method partially solved the problem of perspective, it was unrealistic in that the pulled or propelled dummy did not provide the relative movement which occurred in the actual heading or heeling maneuver. Also, since the movement of both the practice dummy and the horse varied from run-to-run, the trainee could not develop a good uniforming roping motion. Furthermore, this training technique required a good deal of space.

One prior roping training device included a horse simulator mounted on a wheeled and self propelled platform, and a separate propelled roping dummy or target. However, this roping training device was impractical in that it could only be used in large paved areas, was very expensive, and was not capable of constantly repeating the proper relative movement between the rider and the roping target.

SUMMARY OF THE INVENTION

It is therefore a general object of the invention to provide a roping training device and method adapted to overcome the above-described problems and deficiencies, and others associated with prior roping training devices and methods.

Pursuant to these objects, the roping training device according to the invention includes a roping target body and mount simulating means, both preferably mounted on a suitable base. The roping target body simulates an animal such as a steer to be roped while the mount simulating means or mount simulator is adapted to support a trainee in a riding position that is a desired roping distance from the target body. By fixing the mount simulating means and the roping target body in position to simulate an actual roping position, the roping training device according to the invention provides a trainee with a consistent proper perspective from which to develop his roping skills. The consistency in positioning allows the trainee to develop a muscle memory in which the proper roping technique becomes almost automatic.

In the preferred form of the roping training device, the mount simulator is mounted on the base on a suitable mount pivot mechanism on which the mount simulator may pivot about a substantially vertical mount rotational axis. Also, the roping target body is mounted on a target pivot mechanism that enables the roping target body to pivot about a substantially vertical target rotational axis. Pivoting means is connected to both the roping target body and the mount simulator for pivoting each about its respective rotational axis through a desired simulating angular displacement. This pivoting movement of the target body and the mount simulator, combined with a fixed offset between the two rotational axes, produces a relative movement between the target body and the mount simulator that simulates very closely the relative movement of the horse and animal being roped in certain roping maneuvers. The fixed pivots also produce a very consistent relative movement that allows the trainee to develop muscle memory. The device eliminates much of the need for the livestock previously required for roping training and also eliminates the need for large training arenas during the initial training stages or during practicing.

In the preferred form of the invention the target body has two hind legs depending from a rear portion thereof. An animating mechanism is mounted on a support for the target body and connected for moving the legs backward and forward in a manner to simulate the leg movement of a running target. This leg movement simulation is particularly important in training heeling in Dally team roping because the timing of the throw with the steer's leg movement is critical to successfully roping the animal's hind legs.

The leg animating means is also preferably connected for animating the target body itself so as to simulate the body movement of a running target, such as a running steer in Dally team roping. This roping target body movement adds to the realism provided by the training device for practicing both heading and heeling. A common animating motor preferably runs the animating mechanisms that move both the target body itself and the hind legs, and the animating motor is controlled through a switch conveniently mounted on the mount simulator.

The preferred pivoting means or mechanism is housed within the base on which the target body and mount simulator are mounted. The pivoting means includes a pivot linkage connected to both a support for the mount simulator and the support on which the roping target is mounted. A linear actuator is preferably connected between the base and the pivot linkage in position to extend and retract to impart the desired rotation to the target body and mount simulator through the pivot linkage. The linear actuator is preferably controlled through a suitable pivot control switch mounted on the mount simulator. Also, to increase the realism, the current to the linear actuator may additionally be controlled through a rein or chin switch. The rein switch is adapted to be operated by moving reins connected in the standard fashion on the mount simulator to simulate a horse's reins.

In order to produce the desired relative motion between the mount simulator and the roping target body, the mount rotational axis must be properly spaced apart from the target rotational axis. According to the invention, the mount rotational axis is offset from the target rotational axis an initial heeling distance along an X coordinate axis. The mount rotational axis is offset from the target rotational axis an initial heading distance along a Y coordinate axis that is perpendicular to the X axis. Although the pivot points are preferably fixed in place on the base, the mount simulating means preferably includes longitudinal adjusting means for adjusting the riding position relative to the mount rotational axis in order to accommodate trainee preference and physical characteristics.

When the target body and the mount simulator are properly aligned parallel to the Y coordinate axis, the initial heeling distance simulates the distance between the heeling horse and the steer as the steer leaves the chute and runs up the arena in Dally team roping. As the mount simulator pivots approximately 90° counterclockwise in unison with the target body, the relative movement between the two closely simulates the heeling horse turning in behind the steer, and puts the trainee in a desired roping position.

When the target body and mount simulator are both properly aligned with the X axis, the mount simulator positions the trainee in a desired roping position and the position of the header in Dally team roping. Pivoting both the target body and the mount simulator approximately 90° counterclockwise simulates the relative movement of the heading horse and the steer as the heading horse turns the steer off to allow the heeler to get in roping position.

In practicing or simulating heeling or heading according to the invention, it is the pivoting movement of the target body and mount simulator that produces the desired simulation in relative movement. Both the target body and the mount simulator remain fixed on their respective rotational axes throughout the simulation and do not have to move longitudinally as in the actual maneuvers and as in prior training devices. The only longitudinal movement is produced by the longitudinal adjustment on the mount simulator. In order to vary the starting position or training mode of the mount simulator and the target body to simulate both the heeling and heading maneuvers, the mount simulator support and the support for the roping target body both include adjusting means by which the mount simulator and target body may be rotated freely and aligned in the desired starting orientation.

These and other objects, advantages, and features of the invention will be apparent from the following description of the preferred embodiments, considered along with the accompanying drawings.

DESCRIPTION OF THE PREFERRED EMBODIMENTS

Figure 1:
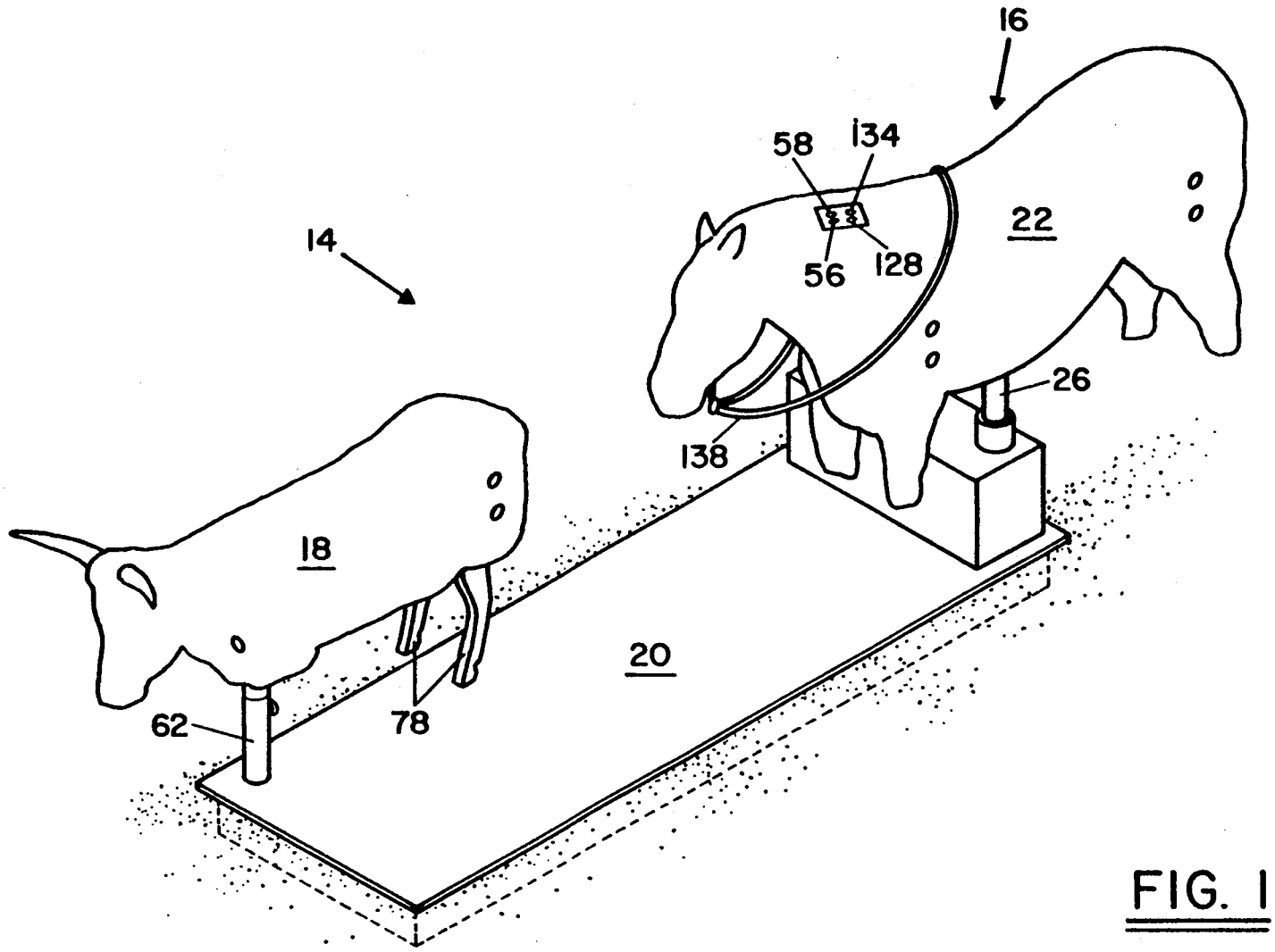
FIG. 1 is a view in perspective of a roping training device embodying the principles of the invention.

As shown in FIG. 1, a roping training device 14 embodying the principles of the invention includes a mount simulator or mount simulating means 16 and a roping target body 18. Both the roping target body 18 and the mount simulator 16 are preferably mounted on a common base 20, which is shown in an installed position with its top surface generally at ground or floor level. The mount simulator 16 is adapted to support a trainee in a riding position at a level above the roping target body and at a desired training distance therefrom. The roping target body 18 is shaped to simulate an animal to be roped, in this form of the invention, a steer.

Figure 2:
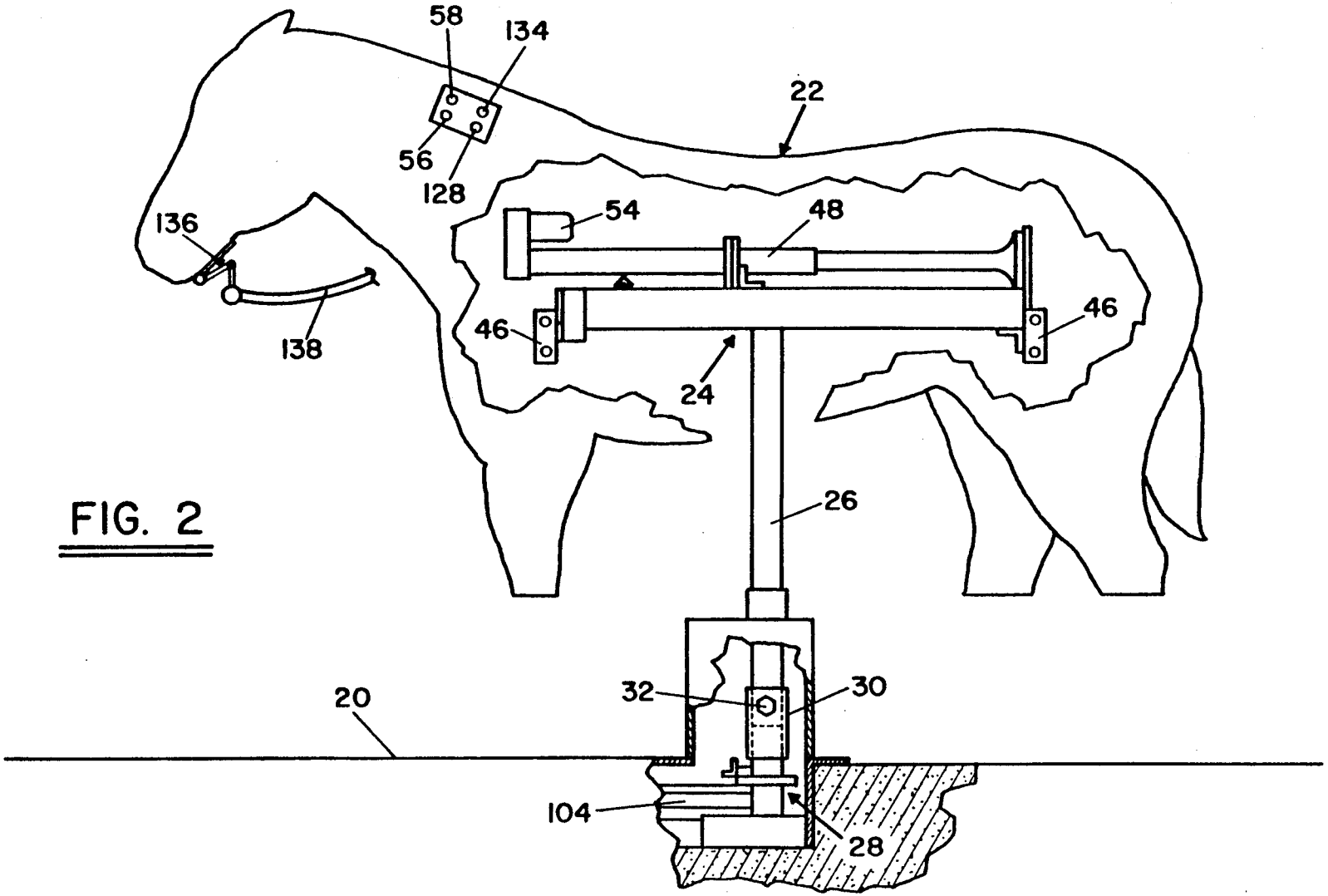
FIG. 2 is view in right side elevation of the mount simulator shown in FIG. 1, partially broken away to show the mount longitudinal adjusting mechanism.

Referring to FIG. 2, the mount simulating means or simulator 16 comprises a replica 22 of a horse on which a standard saddle (not shown) may be installed. The horse replica 22 is preferably formed from a light composite material such as fiberglass and is mounted on a mount frame 24 that includes longitudinal adjusting means by which the training distance may be adjusted. Both the frame 24 and the horse replica 22 are supported above the base 20 on a tubular mount support post 26 connected to the base through a mount pivot mechanism 28. The mount pivot mechanism 28 allows the mount simulator 16 to pivot with the support post 26 about a substantially vertical mount rotational axis. Also, the mount support post 26 includes a mount adjusting mechanism comprising a collar and sleeve arrangement 30 with a set screw 32 for locking the sleeve in position with the collar.

Figure 3:
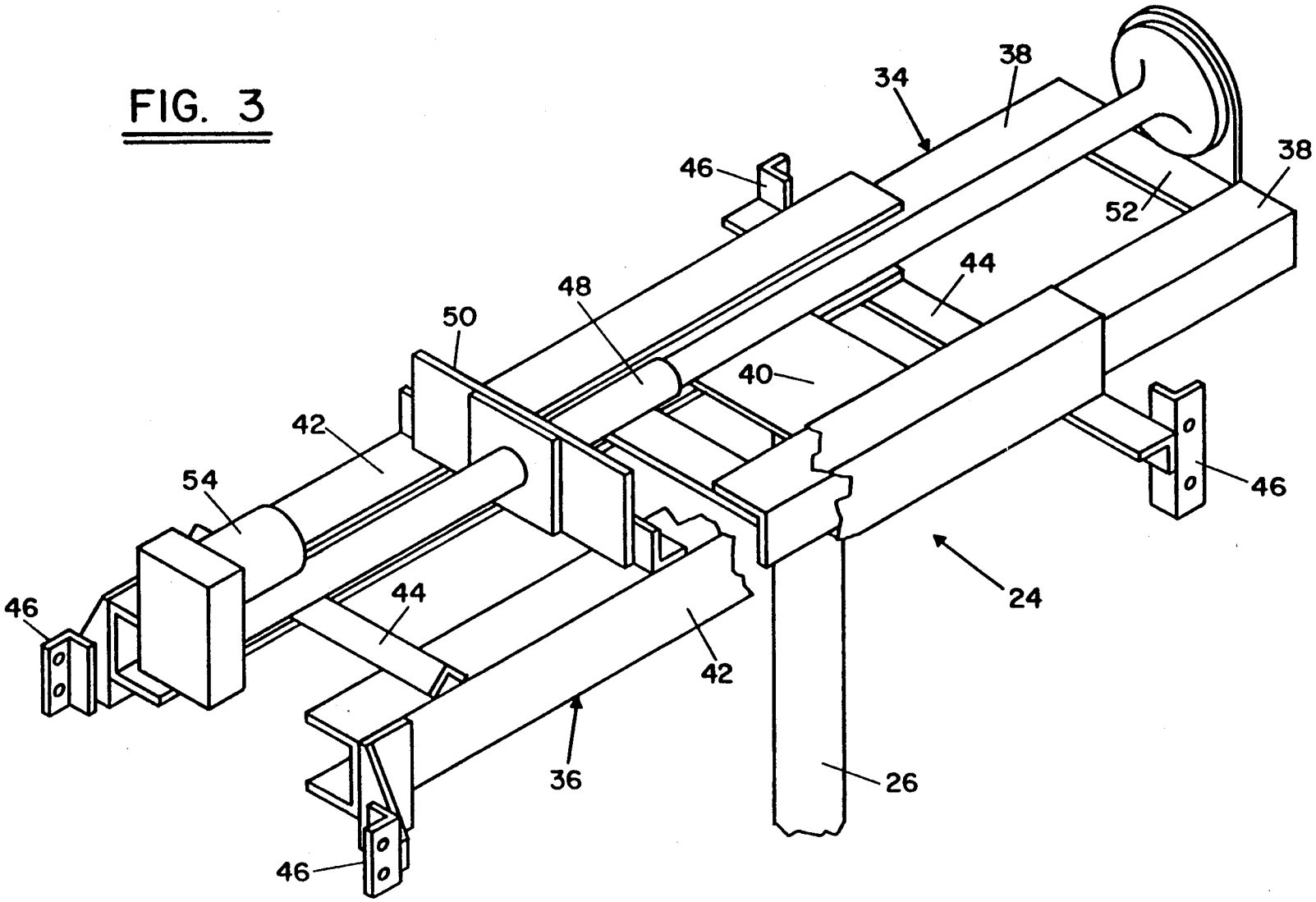
FIG. 3 is an enlarged and partially broken away view in perspective of the mount longitudinal adjusting mechanism.

As shown best in FIG. 3, the mount frame 24 comprises a lower stationary frame 34 and an upper frame 36 that is slidably received on the lower frame. The lower frame includes two parallel angle pieces 38 of suitable material, and is connected by a middle cross member 40 to the top of the mount support post 26. The upper frame 36 includes two parallel channel members 42 connected together at either end by cross members 44 and having at each corner a mounting bracket 46 to which the horse replica 22 may be connected by suitable means.

A telescoping linear actuator 48 is connected at one end to a middle cross member 50 of the upper frame 36 while the opposite end is connected to an end cross member 52 of the lower frame 34. A reversible linear actuator motor 54 operates to extend and retract the linear actuator 48 to provide longitudinal adjustment for the mount simulator 16. As the linear actuator 48 extends, it pushes the upper frame 36 and the horse replica 22 connected thereto forward or to the left in FIGS. 2 and 3. Retracting the linear actuator 48 pulls the upper frame 36 backwards or to the right in FIGS. 2 and 3. A polarity reversing switch 56 and a push-button on/off switch 58 mounted on the left hand side of the horse replica 22 control the operation of the motor 54 and thus the longitudinal adjustment of the horse replica 22 with respect to the support post 26.

Figure 4:
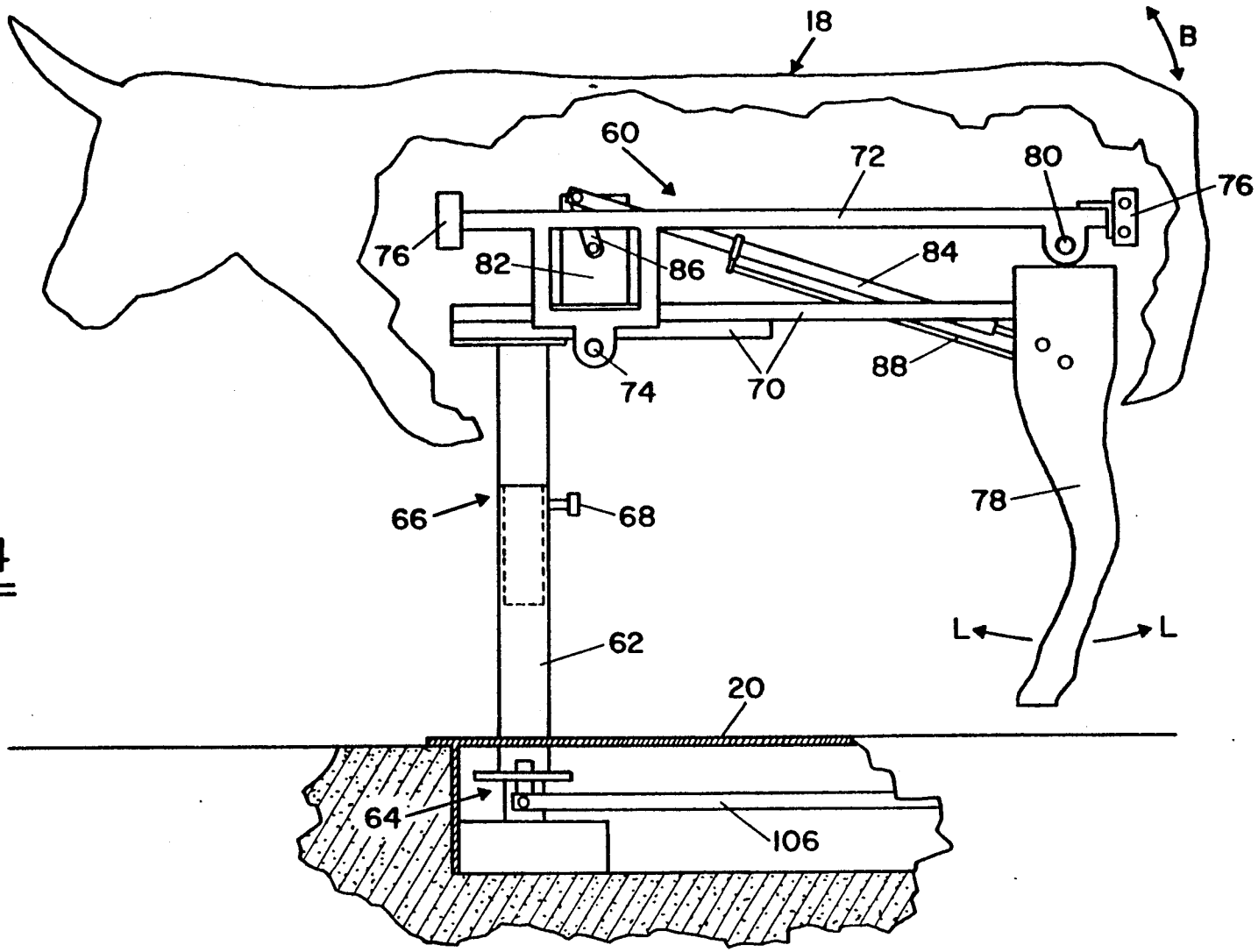
FIG. 4 is a somewhat enlarged view in right side elevation of the roping target shown in FIG. 1, partially broken away to show the animating means.

Referring now to FIG. 4, the roping target body 18, in this case simulating a steer, is supported above the device base 20 on a target frame 60 and a target support post 62. The target support post 62 is mounted on the base 20 on a target pivot mechanism 64 which enables the post and the target body to pivot about a substantially vertical target rotational axis. Similarly to the mount support post 26, the target support post 62 includes a collar and sleeve arrangement 66 by which the alignment of the target body 18 may be adjusted. A set screw 68 locks the collar and sleeve arrangement 66 together to hold the roping target body 18 in a particular alignment.

Figure 5:
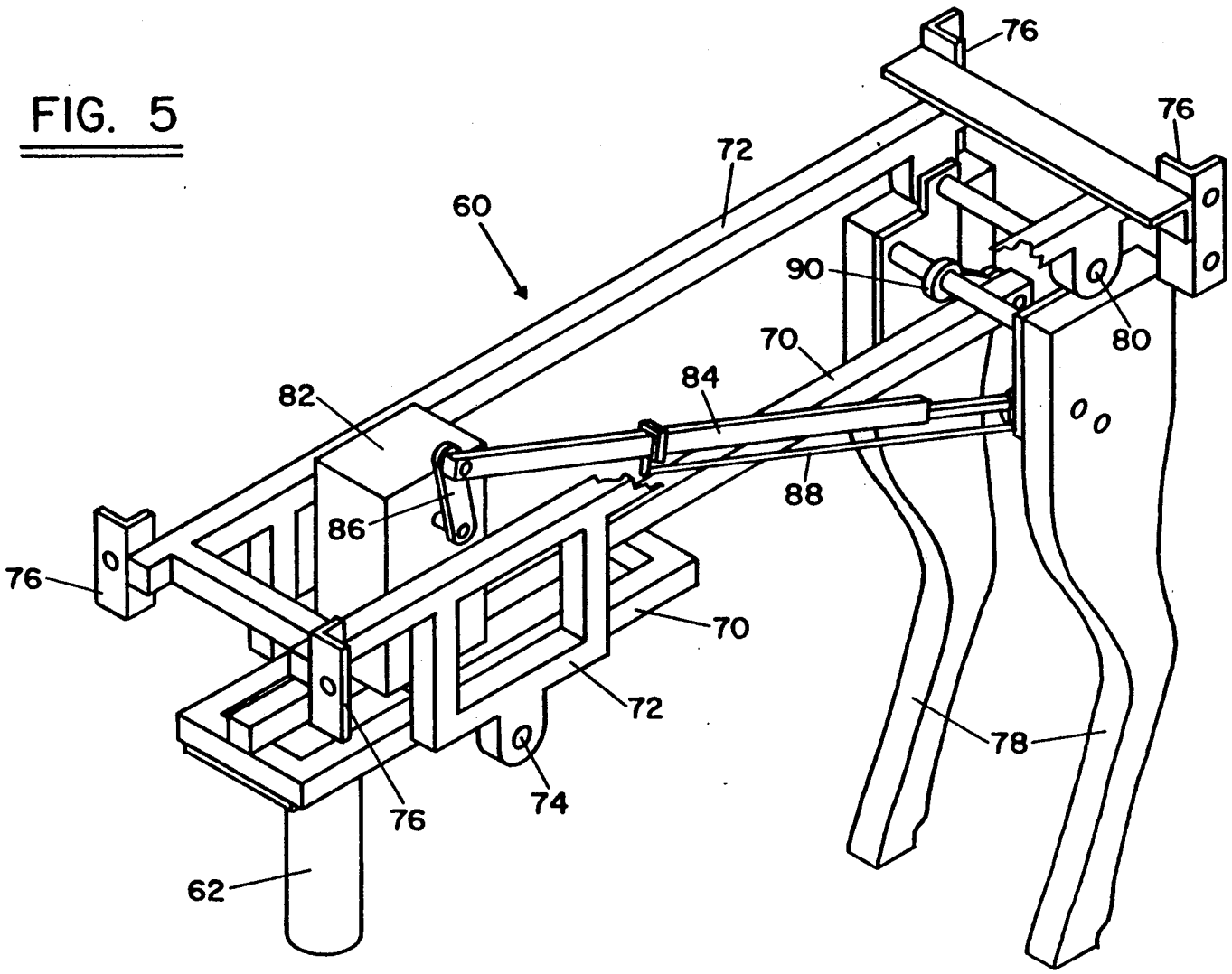
FIG. 5 is a somewhat enlarged view in perspective of the target animating means.

As shown in FIGS. 4 and 5, the target frame 60 includes a stationary lower frame portion 70 on which an upper frame 72 is mounted at a body pivot connection 74. The upper frame 72 includes mounting brackets 76 at its corners on which the roping target body 18 may be mounted by suitable bolts. Also, a pair of elongated hind legs 78 depend from a leg pivot connection 80 at a rear portion of the upper frame 72. Both the body pivot connection 74 and the leg pivot connection 80 form part of the means for animating the target body 18 to enhance the training simulation. The leg pivot connection 80 allows the legs 78 to swing forward and backward to simulate the leg movement of a running steer, while the body pivot connection 74 allows the rear portion of the upper frame 72 and thus the target body 18 to move up and down to simulate the body movement of a running steer.

The animating means further includes an animating motor 82 and a telescopic animating linkage member 84 connected between an eccentric member 86 from the motor shaft and the legs 78. The telescopic animating linkage 84 is biased closed or retracted by a linkage biasing spring 88. Also, an upper frame linkage 90 is pivotally connected at one end to a cross member 92 between the hind legs 78 and at the other end to a rear portion of the lower frame 70. As the animating motor 82 turns, the eccentric member 86 alternately pushes and pulls the animating linkage 84. This movement of the animating linkage 84 swings the hind legs 78 back and forth as shown by the arrows L in FIG. 4. The movement of the legs 78 rearwardly also moves the upper frame linkage 90 to force the rear portion of the upper frame 72 along with the target body 18 upwardly about the body pivot connection 74. As the legs 78 swing forwardly the rear portion of the upper frame and the target body return downwardly. The linkage biasing spring 88 on the telescopic animating linkage 84 allows the linkage to extend only when the legs are pulled back during heeling practice. The telescoping linkage thus prevents damage to the animating motor 82 or any of the animating linkages when the trainee properly ropes the legs.

Figure 6:
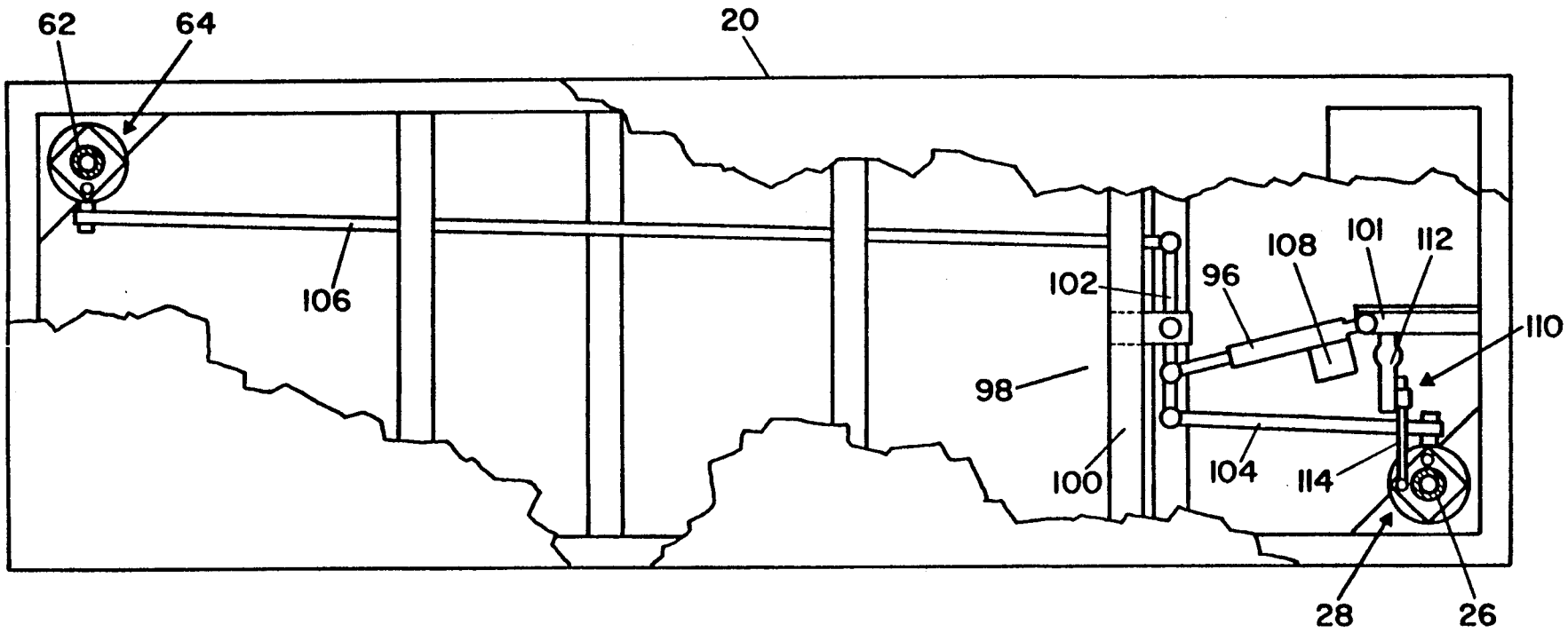
FIG. 6 is a plan view of the pivoting means preferably used in the embodiment of the invention shown in FIG. 1.

Referring to FIG. 6, the roping training device 14 further includes pivoting means for pivoting both the mount simulator 16 and the roping target body 18 about their respective rotational axes. The pivoting means or mechanism is mounted in the device base 20 and includes a pivot linear actuator 96 and a pivot linkage 98 connected to a base cross member 100 and to both the mount and target support posts 26 and 62, respectively at a suitable flange. The pivot linkage 98 comprises a pivot cross member 102 pivotally connected to the base cross member 100, a mount linkage member 104, and a target linkage member 106. The linear actuator 96 is driven by a pivot motor 108 and is pivotally connected at one end to the base cross member 100 and at the other end to the pivot cross member 102. As the linear actuator 96 expands, the pivot cross member 102 pivots about its base connection to pull the mount linkage 104 to the left in the figure and to pull the target linkage 106 to the right. This motion turns both the mount and target support posts 26 and 62, respectively counterclockwise on their respective pivot mechanisms. The linear actuator 96 may be retracted then to return the support posts and pivot mechanisms to the position shown in FIG. 6.

The angular displacement of the support posts 26 and 62 on their respective pivot mechanisms from the position shown in FIG. 6 is limited mechanically to approximately 90°. The desired angular displacement within the mechanical range of the device is preferably controlled by a limit switch mechanism 110 that contains limit switches 116 and 117 (shown in FIG. 7) that act to cut power to the linear actuator motor 108 when a desired angular displacement is achieved. The preferred limit mechanism 110 is pivotally connected between the mount support post 26 at the pivot mechanism 28 and the bracket member 101, and comprises a switch mounting portion 112 and a trip member 114. Each limit switch 116 and 117 (FIG. 7) is positioned on the switch mounting portion 112 and is adapted to open to break power to the linear actuator motor 108 when the switch makes contact with a trip feature 118 (FIG. 7) on the member 114. The relative movement required between the switch mount 112 and the trip member 114 is produced as the mount support post 26 rotates on the mount pivot mechanism 28 and extends or retracts the trip member from the switch mount.

Figure 7:
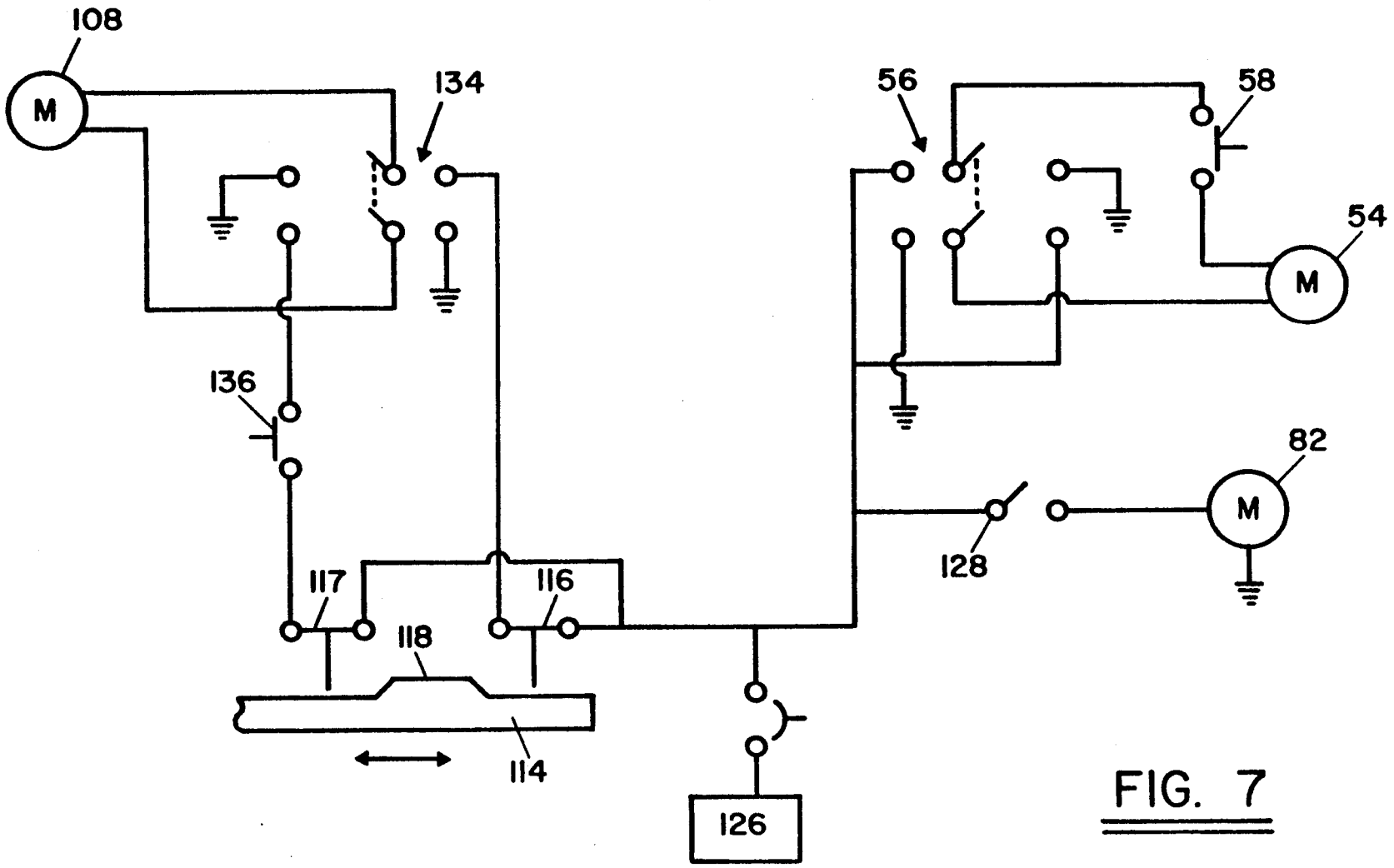
FIG. 7 is an electrical schematic diagram showing the preferred control means.

FIG. 7 shows an electrical schematic of a preferred circuit for controlling the operation of the pivot linear actuator 96, the mount adjusting linear actuator 48, and the animating motor 82. A single DC power source 126 provides electrical power for operating the pivot linear actuator motor 108, the animating motor 82, and the mount adjusting linear actuator motor 54. The animating motor 82 is preferably controlled through a SPST animating control switch 128. As shown in FIGS. 1 and 2 the animating control switch is mounted on the horse replica 22 on the left hand side of the horses neck. The polarity reversing DPDT switch 56 and the on/off push button master switch 58 combine to control the operation of the motor 54 for the mount adjusting linear actuator 48. The pivot linear actuator motor 108 is controlled through the two limit switches 116 and 117, a DPDT polarity reversing switch 134, and a rein switch 136. The on/off master switch 58 for the mount adjusting mechanism and the polarity reversing switches 134 and 56 are mounted on the neck of the horse replica 22 along with the animating control switch 128 as shown in FIGS. 1 and 2. As shown best in FIG. 2, the rein on/off switch 136 is mounted on the chin of the horse replica 22 and is connected to be toggled open and closed by lifting reins 138. Both of the motors 54 and 108 are reversible DC motors which are reversed by reversing the polarity to the motor windings through the polarity reversing switches 56 and 134.

Figure 8:
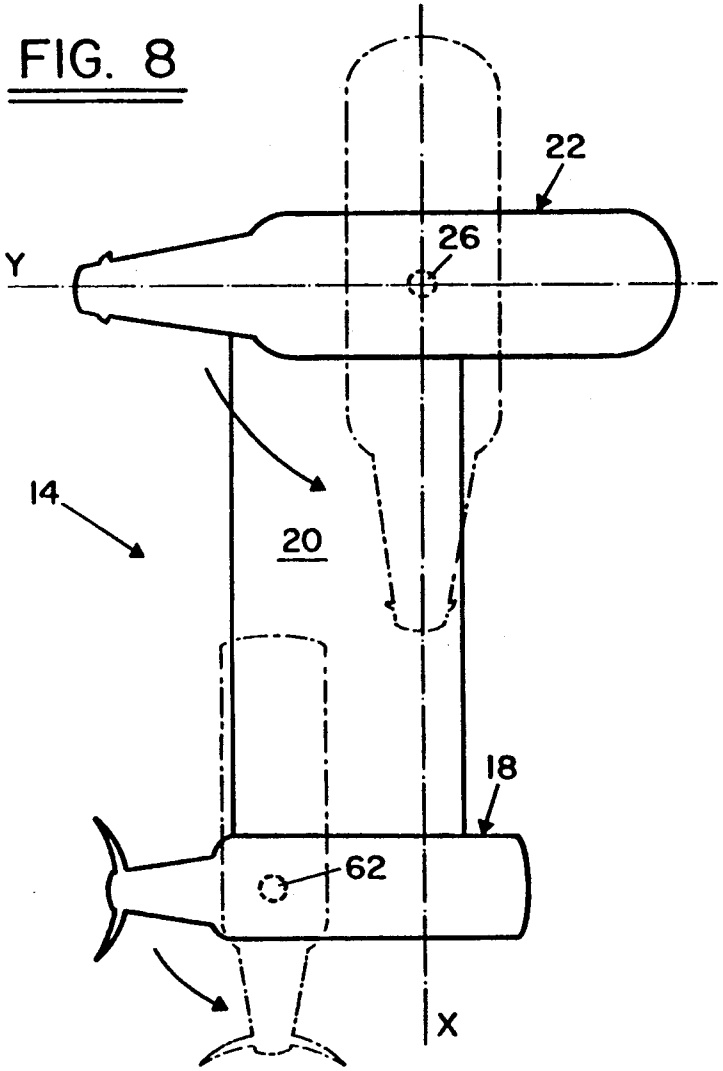
FIG. 8 is a schematic top plan view showing the movement of the invention in a heeling simulation mode.

The operation of the roping training device 14 and the method of training according to the invention may now be described with reference to FIGS. 8 and 9. FIG. 8 shows somewhat schematically the position and movement of the mount simulator 16 and roping target body 18 in a heeling mode of operation. Also, FIG. 8 clearly shows the preferred pivot offset which provides the desired relative motion between the mount simulator 16 and the roping target body 18. The mount rotational axis is offset from the target rotational axis and initial heeling separation distance along an X coordinate axis and an initial heading separation distance along a Y coordinate axis.

In the heeling mode of operation, the roping target body 18 and the mount simulator 16 are both aligned with each extending generally parallel with the Y axis, having been aligned using the respective adjusting arrangements built into the support posts 26 and 62. This initial heeling position simulates very closely the position of a heeling horse as it follows the steer out of the chute in Dally team roping. From this first or initial heeling position, the method of the invention includes pivoting both the roping target body 18 and the mount simulator 16 about their respective rotational axes counterclockwise through a desired training angular displacement, preferably 90°, to a second or roping position shown in dashed lines. This pivoting or rotational movement from the initial heeling to the roping position simulates the relative movement of the steer and the heeling horse in Dally team roping as the heeling horse turns in behind the steer to the proper roping position. Thus the pivoting movement provides a trainee mounted on the horse replica 22 with a consistent and accurate simulation for training or practicing the throw of a rope in the heeling maneuver. Although the 90° simulating displacement is preferred, those skilled in the art will readily appreciate that the angular displacement may be varied to vary the angle at which the mount simulator 16 turns in behind the roping target body 18. Different mount simulator 16 and roping target body 18 alignments and angular displacements enable the device 14 to accommodate various roping styles, types, and preferences.

The pivoting movement in the heeling mode of operation is produced by operating the pivot linear actuator motor 108 in the polarity required to extend the linear actuator 96 (FIG. 6). The trainee operates the motor 108 by throwing the reversing switch 134 into the proper polarity and closing the rein switch 136 by lifting up on the reins 138. The trainee may stop the rotation by lifting up on the reins and then may restart the rotation by again lifting up on the reins 138 to close the rein switch 136.

The method of the invention also preferably includes moving the hind legs 78 of the roping target body 18 to simulate the leg movement of a desired target. This hind leg movement simulation is particularly important in training the heeling maneuver since the timing of the throw with the leg movement of the steer is critical to a successful throw. The method also preferably includes moving the target body 18 about the forward or body pivot connection 74 to simulate the body movement of a desired target. This body movement also affects the position of the hind legs 78 and thus affects the timing of the throw in heeling. As described above, both the movement of the hind legs and the movement of a target body 18 are produced by animating means described above with respect to FIGS. 3 and 4 mounted within the roping target body and controlled through the control switch 128 mounted on the left hand side of the neck of the horse replica 22.

Figure 9:
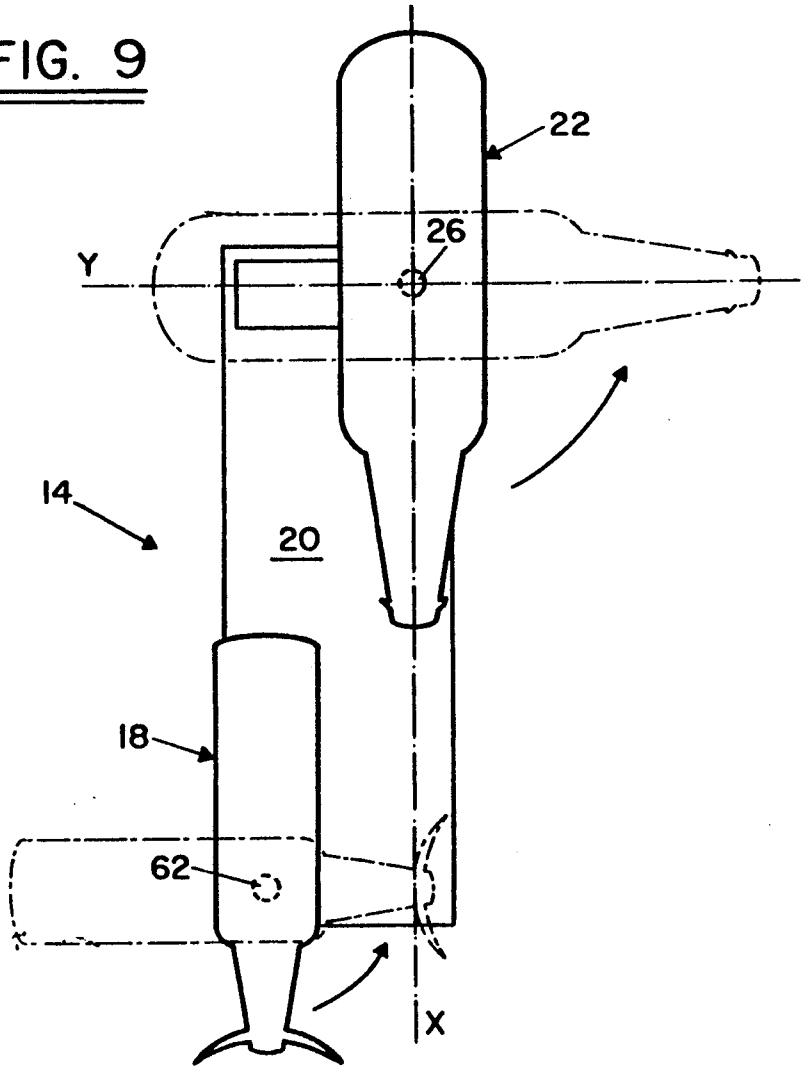
FIG. 9 is a schematic top plan view showing the movement of the invention in the heading simulation mode.

FIG. 9 shows the operation of the roping training device in a heading mode of operation. In the heading mode of operation the target body and the mount simulator both begin in a first position generally parallel to the X coordinate axis. This position corresponds to the second or roping position in the heeling mode of operation and also simulates the relative position of the heading horse as it follows the steer out of the chute in Dally team roping. From this position a trainee seated on the horse replica 22 on a suitable saddle (not shown) may consistently practice roping the steer around its horns from the proper roping position to develop a muscle memory for the proper throw. Once the rope is thrown around the roping target body 18 horns, the method of the invention includes pivoting both the roping target body and the mount simulator about their respective rotational axes counterclockwise the desired simulating angular displacement, and preferably approximately through an angular displacement of 90°, to the second or finishing position shown in dashed lines in FIG. 9. The relative movement between the mount simulator 16 and roping target body 18 from this rotation simulates very closely the relative movement between the heading horse and the steer as the heading horse turns the steer off to enable the heeling horse to come in behind the steer to the proper roping position. As in the pivoting movement shown in FIG. 8, the pivoting movement from the first to the finishing position shown in FIG. 9 is produced by the pivoting means mounted in the device base 20 and driven by the pivot linear actuator 96.

The above described preferred embodiments are intended to illustrate the principles of the invention, but not to limit the scope of the invention. Various other embodiments and modifications to these preferred embodiments may be made by those skilled in the art without departing from the scope of the following claims. For example, various pivoting mechanisms and control circuits may be employed to provide the desired pivoting movement for the mount simulator and the roping target body. Also, a device according to the invention may include a second mount simulator mounted on the base and offset a desired distance for training both the heading and heeling maneuvers simultaneously. Further, although the device is described in terms of training for Dally team roping, it will readily be appreciated that the device may be employed for recreational purposes and for training other roping styles and types.

I claim:

1. A roping training device comprising:

(a) a device base including a rigid frame and a planar top surface;

(b) an elongated roping target body;

(c) an elongated target body support member rigidly connected at one end to the base and connected at its opposite end to the target body;

(d) a mount simulator having a saddle on which a trainee may be seated in a riding position; and (e) an elongated mount simulator support member rigidly connected at one end to the base and connected at its opposite end to the mount simulator so as to support the mount simulator at a fixed training position with respect to the roping target body.

2. The roping training device of claim 1 further including:

(a) two elongated spaced apart hind legs depending from a rear portion of the roping target body; and (b) leg animating means connected to the leg members for moving the leg members in a manner to simulate the hind leg motion of a desired target.

3. The roping training device of claim 2 further including:

(a) target body animating means for moving the roping target body in a manner to simulate the body motion of a desired target.

4. The roping training device of claim 3 further including:

(a) a target body pivot mechanism connected to the target body support member and enabling the roping target body to pivot about a substantially vertical target rotational axis;

(b) a mount pivot mechanism connected to the mount support member and enabling the mount simulating means to pivot about a substantially vertical mount rotational axis; and (c) the mount rotational axis and the target rotational axis being offset a desired initial heeling separation distance along an X coordinate axis and a desired initial heading separation distance along a Y coordinate axis, the X and Y coordinate axes being perpendicular to each other and defining a substantially horizontal plane.

5. A roping training device comprising:

(a) an elongated roping target body supported in a position to simulate a desired roping target;

(b) a target body pivot mechanism connected to the roping target body and enabling the roping target body to pivot about a substantially vertical target rotational axis;

(c) mount simulating means for supporting a trainee in a riding position above the level of the roping target body and within a desired training distance range from the target rotational axis, the mount simulating means having a mount axis;

(d) a mount pivot mechanism connected to the mount simulating means and enabling the mount simulating means to pivot about a substantially vertical mount rotational axis;

(e) the mount rotational axis and the target rotational axis being offset a desired initial heeling separation distance along an X coordinate axis and a desired initial heading separation distance along a Y coordinate axis, the X and Y axes being perpendicular to each other and defining a substantially horizontal plane; and (f) pivoting means for pivoting the mount simulating means about the mount rotational axis and the roping target body about the target rotational axis, each a simulating angular displacement in the same rotational direction from a first position in which the mount axis and the target longitudinal axis are both substantially parallel to an arena axis and a second position in which the mount axis and the target longitudinal axis are both parallel to a finishing axis.

6. The roping training device of claim 5 wherein:

(a) the simulating angular displacement is approximately 90° so that the finishing axis is an axis generally perpendicular to the arena axis.

7. The roping training device of claim 5 wherein the pivoting means is also for returning the mount simulating means and the roping target body from the second to the first position.

8. The roping training device of claim 5 including:

(a) target adjusting means connected between the roping target body and the target body pivot mechanism for enabling the target body longitudinal axis to be aligned parallel to either the Y or X axis in the first position; and (b) mount adjusting means connected between the mount simulating means and the mount pivot mechanism for enabling the mount axis to be aligned parallel to either the Y or X axis in the first position.

9. The roping training device of claim 5 wherein the pivoting means pivots the mount simulating means and the roping target body simultaneously from the first position to the second position so that the mount axis and the target longitudinal axis remain generally parallel to each other throughout the rotation.

10. The roping training device of claim 5 further including:

(a) two elongated and laterally spaced apart hind legs depending from a rear portion of the roping target body; and (b) target leg animating means for moving the hind legs in a manner to simulate the hind leg motion of a desired target.

11. The roping training device of claim 10 further including:

(a) target body animating means for moving the target body in a manner to simulate the body motion of a desired target.

12. The roping training device of claim 11 wherein both the target body animating means and the target leg animating means include:

(a) a common animating electrical drive motor; and (b) an on/off control switch mounted on the mount simulating means for controlling the operation of the animating drive motor.

13. The roping training device of claim 5 wherein the mount simulating means includes:

(a) longitudinal adjusting means for enabling the riding position provided by the mount simulating means to be adjusted along the mount axis in various positions with respect to the mount rotational axis.

14. The roping training device of claim 5 wherein the pivoting means comprises:

(a) a pivot linkage connected to a roping target body support member on which the roping target body is supported on the target body pivot mechanism, and connected to the mount simulating means; and (b) a pivot linear actuator connected between the pivot linkage and a fixed point for extending and retracting to manipulate the pivot linkage so as to pivot the mount simulating means about the mount rotational axis and the roping target body about the target rotational axis.

15. The roping training device of claim 14 further including:

(a) control means for controlling the operation of the pivot linear actuator.

16. The roping training device of claim 15 wherein the control means includes:

(a) a rein switch for selectively closing or opening an electrical circuit to the pivot linear actuator from a suitable power supply; and (b) reins connected to the mount simulating means by which the rein switch may be operated.

17. A roping training method comprising the steps:

(a) placing an elongated roping target body and an elongated mount simulator in a first position in which the mount and target longitudinal axes are substantially parallel to an arena axis and offset from each other a first simulating distance; and (b) rotating the roping target body about a substantially vertical target rotational axis and the mount simulator about a substantially vertical mount rotational axis each a simulating angular displacement in the same rotational direction to a second position in which the mount and target longitudinal axes are substantially parallel to a finishing axis and offset from each other a second simulating distance.

18. The method of claim 17 wherein the roping target body has two spaced apart hind legs depending from a rear portion thereof and including the step of:

(a) moving the rear legs to simulate the leg movement of a desired target.

19. The method of claim 18 including the step of:

(a) moving the target body about a body pivot point to simulate the body movement of a desired target.

20. The method of claim 17 including the step of:

(a) maintaining the mount and target longitudinal axis substantially parallel to each other as the roping target body and the mount simulator are rotated from the first position to the second position.

* * * * *